US009114285B2

(12) United States Patent
Guo et al.

(10) Patent No.: US 9,114,285 B2
(45) Date of Patent: Aug. 25, 2015

(54) TENNIS BALL PICK-UP CART

(71) Applicants: Alexander K. Guo, State College, PA (US); Guinfeng Chen, Qinhuangdo (CN)

(72) Inventors: Alexander K. Guo, State College, PA (US); Guinfeng Chen, Qinhuangdo (CN)

( * ) Notice: Subject to any disclaimer, the term of this patent is extended or adjusted under 35 U.S.C. 154(b) by 0 days.

(21) Appl. No.: 14/204,494

(22) Filed: Mar. 11, 2014

(65) Prior Publication Data

US 2014/0294547 A1 Oct. 2, 2014

(30) Foreign Application Priority Data

Mar. 26, 2013 (CN) ..... 2013 1 0097897
Mar. 26, 2013 (CN) ..... 2013 2 0139146 U

(51) Int. Cl.
*B60P 1/00* (2006.01)
*A63B 47/02* (2006.01)
*A63B 24/00* (2006.01)

(52) U.S. Cl.
CPC ..... *A63B 47/021* (2013.01); *A63B 24/00* (2013.01); *A63B 2047/022* (2013.01); *A63B 2225/50* (2013.01); *A63B 2243/0083* (2013.01)

(58) Field of Classification Search
CPC ..... A63B 47/021; A63B 2047/022; A63B 2243/0083
USPC ..... 414/437, 439, 440, 441; 294/19.2
See application file for complete search history.

(56) References Cited

U.S. PATENT DOCUMENTS

| | | | | |
|---|---|---|---|---|
| 4,221,524 | A * | 9/1980 | Morris | 414/439 |
| 6,079,930 | A * | 6/2000 | Valdes-Rodriguez | 414/440 |
| 8,602,711 | B1 * | 12/2013 | Nash et al. | 414/440 |
| 2008/0039974 | A1 * | 2/2008 | Sandin et al. | 700/258 |
| 2012/0093621 | A1 * | 4/2012 | Reyes | 414/507 |
| 2013/0064631 | A1 * | 3/2013 | Leyco et al. | 414/439 |

* cited by examiner

*Primary Examiner* — Saul Rodriguez
*Assistant Examiner* — Mark Hageman
(74) *Attorney, Agent, or Firm* — Harness, Dickey & Pierce, P.L.C.

(57) ABSTRACT

A tennis ball pick-up cart comprises a chassis including a pair of driven wheels and a pair of steering wheels. A ball collection case is coupled to the chassis. A ball pick-up mechanism includes a concave ball guiding plate laterally placed under two vertical side plates. The ball pick-up mechanism also includes a fixing shaft and a rotating shaft each laterally extending between the vertical side plates. Synchronous belt pulleys are provided on the fixing shaft and the rotating shaft. Two synchronous belts are assembled with two of the synchronous belt pulleys. Laterally placed ball-moving plates are evenly distributed on an outer surface of each of the synchronous belts. Each of the ball moving plates includes a ball moving surface perpendicularly connected to the outer surface of each of the belts. An electric motor drives the driven wheels and the rotating shaft.

12 Claims, 5 Drawing Sheets

TENNIS BALL PICK-UP CART

CROSS-REFERENCE TO RELATED APPLICATIONS

This application claims the benefit and priority of Chinese application number 201320139146.5, filed Mar. 26, 2013, and Chinese application number 201310097897.X, filed Mar. 26, 2013. The entire disclosures of each of the above applications are incorporated herein by reference.

FIELD

The present application relates to a tennis ball pick-up cart for picking up a tennis ball in a tennis court.

BACKGROUND

With the increasing improvement of living standard, there are more and more tennis participants. Generally during playing tennis, in particular in tennis serve training, a great number of tennis balls are served. Presently, during playing tennis, tennis balls are generally picked up manually. However, since a tennis court has a large area, it is time-consuming and laborious to pick up tennis balls manually. In the prior art, a tennis ball pick-up cart for picking up tennis balls during playing tennis has been proposed. However, it is difficult to make the tennis ball pick-up cart popularized, because it has an unreasonable structural design and thus works poorly in practice.

SUMMARY

An object of the present application is to provide a tennis ball pick-up cart with a unique and reasonable structural design and providing a good effect in practical use.

The object is achieved by the following technical solution. A tennis ball pick-up cart includes a chassis equipped with a pair of driving rear wheels and a pair of steering front wheels, wherein a ball pick-up mechanism of moving plate type is provided at the front of the chassis, and a ball collection case with an open top end is provided at the rear of the chassis. The ball pick-up mechanism includes two vertically placed side plates placed on two sides thereof respectively and a ball guiding plate with a concave curved surface which is laterally placed underneath the rear of the two vertically placed side plates. A laterally placed fixing shaft is provided at upper parts of the two vertically placed side plates. A laterally placed rotating shaft is provided at lower parts of the two vertically placed side plates.

A pair of synchronous belt pulleys is provided on each of the fixing shaft and the rotating shaft, such four synchronous belt pulleys each being placed inside the two vertically placed side plates. Two synchronous belts are assembled with two of the synchronous belt pulleys on the same side and laterally placed ball-moving plates are evenly distributed on an outer surface of each of the synchronous belts. Each of the ball-moving plates includes a ball-moving surface perpendicularly connected to the surface of each of the synchronous belts. Each of the steering front wheels is assembled with a vertically placed steering lever. An upper end of each of the two steering levers is connected to a pair of laterally placed steering gear connecting plates. The steering gear connecting plates are both connected to a steering gear. A laterally placed steering gear fixing plate is provided at front ends of the two vertically placed side plates. The steering gear is fixed on the steering gear fixing plate.

An electric motor is provided underneath the chassis. The electric motor has an output shaft connected to a wheel shaft of the two driving rear wheels via a rear wheel driving synchronous belt transmission mechanism and also connected to the rotating shaft of the ball pick-up mechanism via a ball-moving plate driving synchronous belt transmission mechanism which is assembled with an overrunning clutch. The chassis is provided thereon with a power switch, an on-board battery charge socket, a radio signal remote receiver and an electronic speed regulator.

Brush wheels are provided at a front end of the chassis. The two brush wheels are respectively placed on two sides of the front end of the chassis, and vertically placed brush wheel shafts for the two brush wheels are connected to the rotating shaft via brush wheel transmission belts.

Curved handle fixing frames being convex upwardly are provided on the chassis. The two handle fixing frames are located outside the two vertically placed side plates of the ball pick-up mechanism and outside two sidewalls of the ball collection case. A laterally placed cart body handle is provided at upper ends of the two handle fixing frames.

Guiding plates are provided at the front end of the chassis, and the two guiding plates are placed on the two sides of the front of the chassis respectively.

The steering gear is equipped with a protective cover, and two ends of the protective cover are fixed on the handle fixing frames.

The tennis ball pick-up cart has a reasonable structural design, and can be operated to pick up tennis balls in a tennis court reliably and effectively.

DRAWINGS

DETAILED DESCRIPTION

Figure 1:
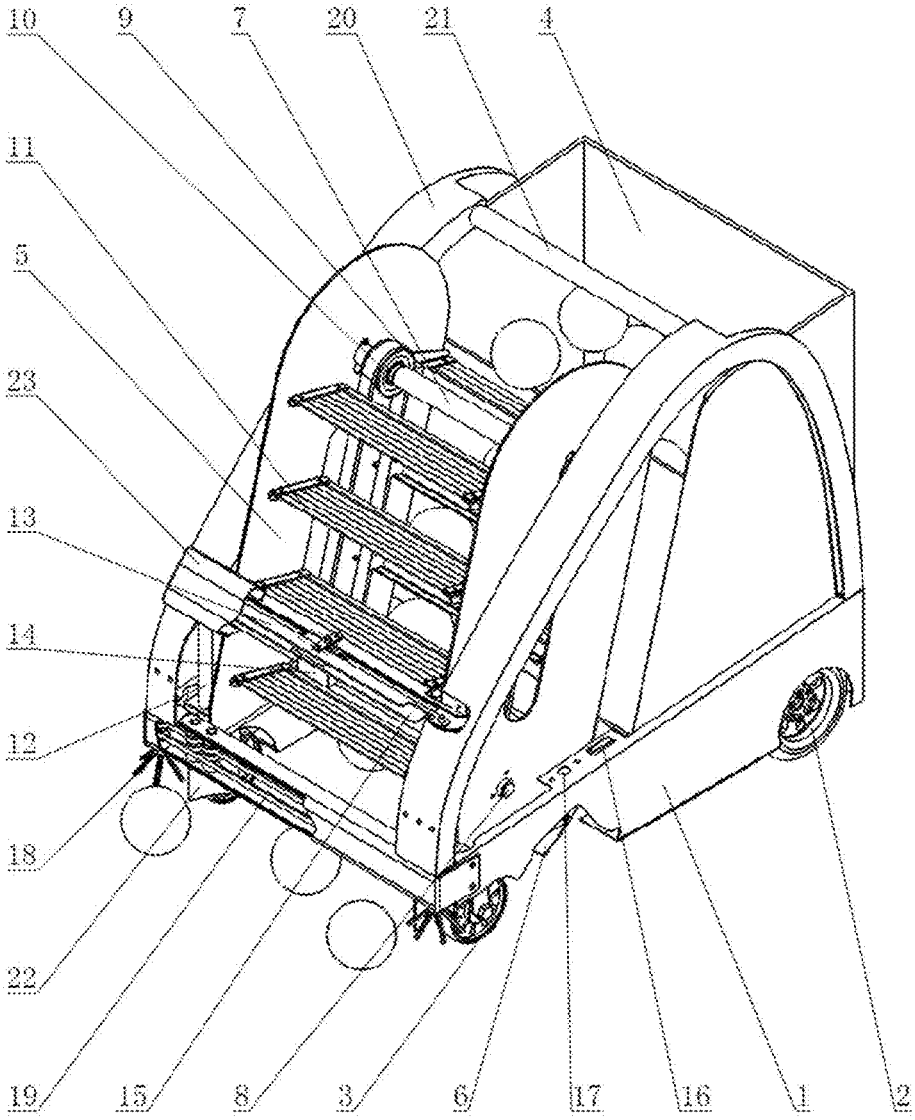
FIG. 1 is a structural schematic view of a tennis ball pick-up cart according to the present application.
Figure 2:
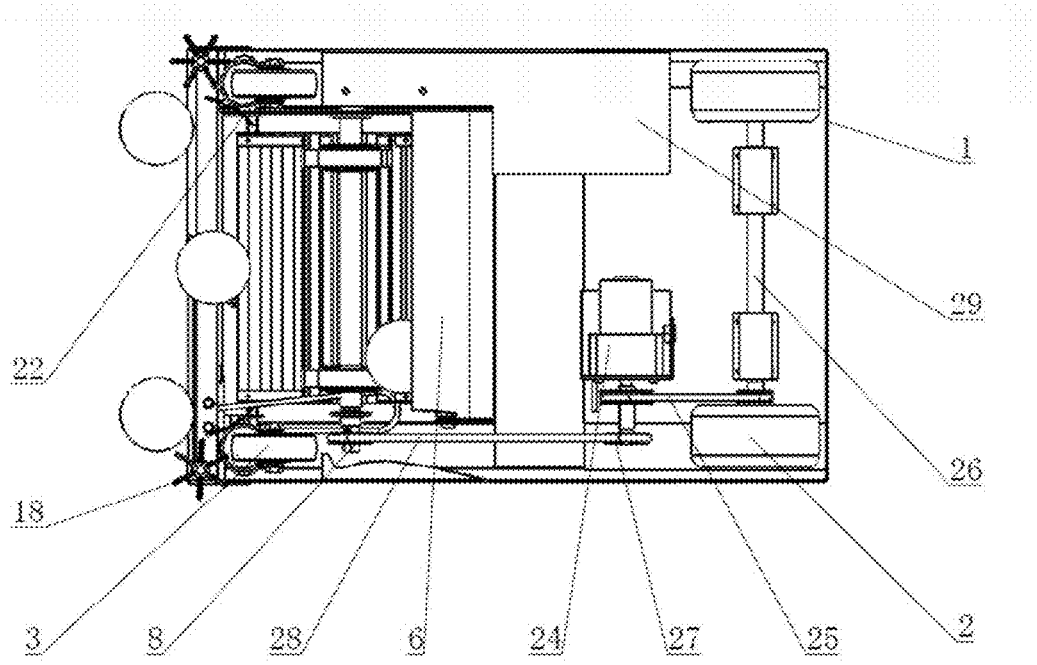
FIG. 2 is a bottom view of the tennis ball pick-up cart according to the present application.
Figure 3:
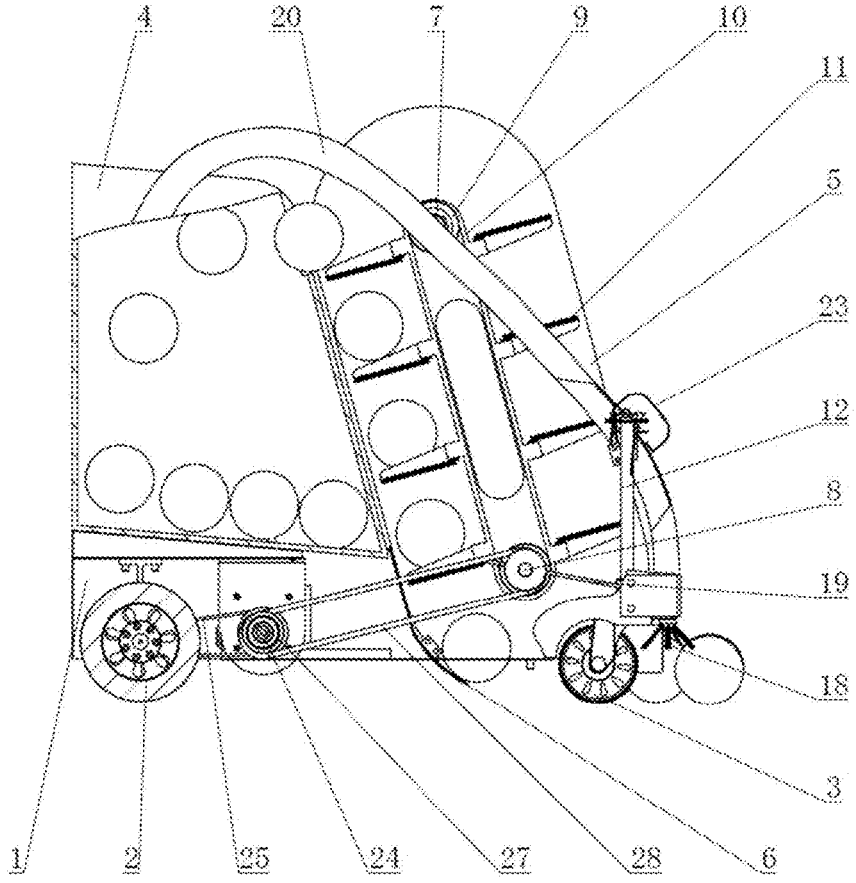
FIG. 3 is a side sectional view of the tennis ball pick-up cart according to the present application.

Exemplary embodiments of the present application will be described in conjunction with the accompanying drawings.

As shown, a tennis ball pick-up cart according to the present application includes a chassis 1. The chassis 1 is configured to have a rectangular frame structure including two side panels and a rear panel. The chassis 1 is equipped, at the rear thereof, with a pair of driving rear wheels 2 provided on two sides of a cart body respectively, and is equipped, at the front thereof, with a pair of steering front wheels 3 arranged on the two sides of the cart body respectively.

A ball pick-up mechanism of a moving plate type is provided at the front of the chassis 1. A ball collection case 4 being open at the upper end thereof is provided at the rear of the chassis 1. The ball pick-up mechanism is fixedly connected to the chassis 1. The ball collection case 4 is placed on the chassis 1. As shown, the ball collection case 4 includes a front panel provided to be tilted backwards by 5 degrees to 30 degrees, and the ball pick-up mechanism of cycle ball-moving plate type is fitted with the titled front panel and has a vertical central line tilted backwards by 5 degrees to 30 degrees.

The ball pick-up mechanism has two vertically placed side plates 5 arranged at two sides thereof respectively, and a ball guiding plate 6 with a concave curved surface which is laterally placed underneath the rear of the two vertically placed side plates 5. The concave curved surface of the ball guiding plate 6 faces towards the front of the cart body. A laterally placed fixing shaft 7 is provided at the upper parts of the two vertically placed side plates 5, and a laterally placed rotating shaft 8 is provided at the lower parts of the two vertically placed side plates 5. Each of the fixing shaft 7 and the rotating shaft 8 is provided thereon with a pair of synchronous belt pulleys 9. Such four synchronous belt pulleys 9 are each provided inside the two vertically placed side plates 5. Specifically, two synchronous belt pulleys provided on the fixing shaft 7 are rotatably assembled with the fixing shaft 7, while two synchronous belt pulleys provided on the rotating shaft 8 are fixedly assembled with the rotating shaft 8. The two synchronous belt pulleys 9 on the same side are equipped with a synchronous belt 10.

Multiple laterally placed ball-moving plates 11 are evenly distributed on an outer surface of each of the two synchronous belts 10. Each of the ball-moving plates 11 has a ball-moving surface which is perpendicularly connected to the surface of the corresponding synchronous belt 10. The ball-moving plate 11 according to the present application is adapted to have a combination structure including a rigid frame and an elastic ball-moving plate body. The rigid frame is formed of two side frames and a rear frame. The elastic ball-moving plate body can be an elastic rubber plate or can be composed of multiple aligned elastic rubber belts.

Each of the steering front wheels 3 is assembled with a vertically placed steering lever 12. Upper ends of the two steering levers 12 are connected to a pair of laterally placed steering gear connecting plates 13 arranged to be one behind the other. Such two steering gear connecting plates 13 are connected to a steering gear 14. A laterally placed steering gear fixing plate 15 is provided at front ends of the two vertically placed side plates 5. The steering gear 14 is fixed on the steering gear fixing plate 15.

An electric motor 24 is provided underneath the chassis 1. The electric motor 24 has an output shaft which is connected to a wheel shaft 26 of the two driving rear wheels 2 via a rear wheel driving synchronous belt transmission mechanism 25, and is also connected to the rotating shaft 8 of the ball pick-up mechanism via a ball-moving plate driving synchronous belt transmission mechanism 28 equipped with an overrunning clutch 27, so as to drive the cart body to move forward or backward and so as to drive the ball-moving plates 11 to run in a single direction. On the chassis 1, provided are a power switch 16, an on-board battery charge socket 17, a radio signal remote receiver and an electronic speed regulator 29 to achieve turning-off of the power supply of the cart body, charge an on-board battery and receive a remote signal sent from a radio signal remote transmitter, so as to control the cart body to change direction, run forward and backward.

Figure 4:
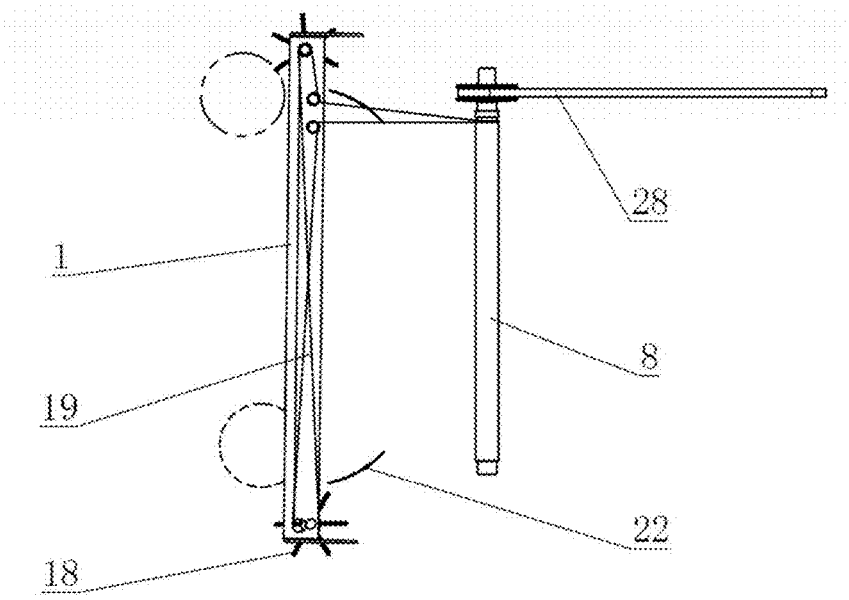
FIG. 4 is a schematic view of a bush wheel transmission structure of the tennis ball pick-up cart according to the present application.
Figure 5:
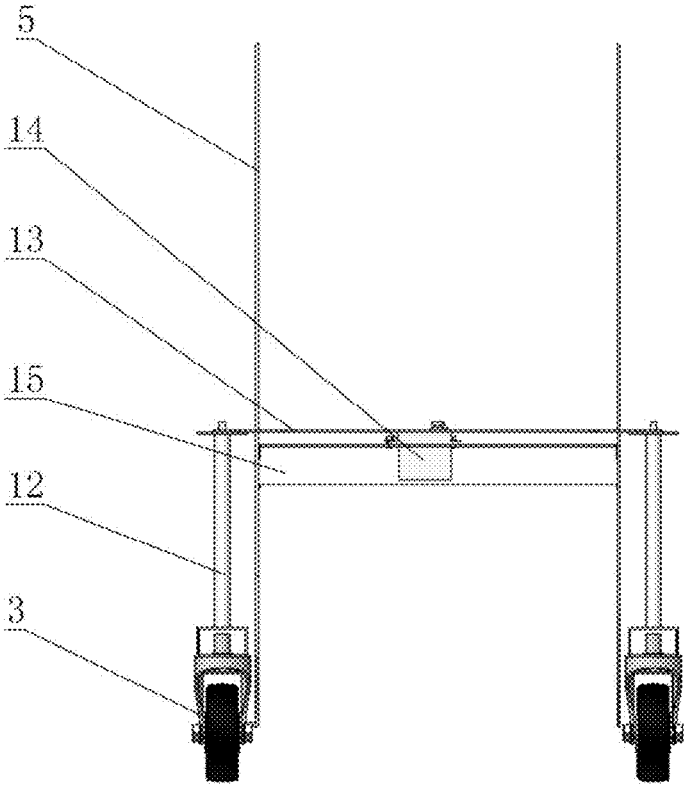
FIG. 5 is a structural schematic view of the configuration of a steering front wheel and a steering gear of the tennis ball pick-up cart according to the present application.

Brush wheels 18 are provided at a front end of the chassis 1, specifically, at two sides of the front end of the chassis 1 respectively. The brushes, while rotating, drive tennis balls on the two sides of the cart body to reach the middle part of the front of the cart body, so as to facilitate collecting tennis balls located near a wall or at a corner. Each brush wheel 18 is provided with a vertically placed brush wheel shaft which is connected to the rotating shaft 8 via a brush wheel transmission belt 19. The brush wheel transmission belt 19 can preferably adopt a belt with a circular cross section. The brush wheel transmission belt 19 can be configured as shown in FIG. 4. The brush wheel transmission belt 19 drives the brush wheel to rotate by means of the rotating shaft 8. Two brush wheels may be rotated inwardly towards each other via multiple belt steering wheels arranged on the chassis 1.

Curved handle fixing frames 20 being convex upwardly are provided on the chassis 1. Such two handle fixing frames 20 are located outside the two vertically placed side plates 5 of the ball pick-up mechanism and outside two sidewalls of the ball collection case 4. A laterally placed cart body handle 21 is provided on upper ends of the two handle fixing frames 20. On the one hand, the two handle fixing frames 20 function to fix the ball pick-up mechanism, and on the other hand, function to protect the ball pick-up mechanism while stabilizing the ball collection case 4. Two curved guiding plates 22 are respectively provided at the two sides of the front end of the chassis 1 so as to prevent collected tennis balls from interfering with two side frames of the ball-moving plate 11. Additionally, the steering gear 14 is provided with a protective cover 23 for protecting the steering gear 14, the steering gear connecting plate 13 and other driven mechanisms. The protective cover 23 has two ends fixed on the two handle fixing frames 20 respectively.

The present application is provided with a radio signal remote transmitter for remotely controlling the operation of the tennis ball pick-up cart.

According to the present application, the steering gear, the radio signal remote transmitter, the radio signal remote receiver and the electronic speed regulator can adopt a steering gear for a car model, a remote transmitter for a car model, a remote receiver and an electronic speed regulator for a car model.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A tennis ball pick-up cart, comprising:

a chassis including a pair of driven wheels and a pair of steering wheels;

a ball collection case including an open top coupled to the chassis;

a ball pick-up mechanism including two vertical side plates and a ball guiding plate, the ball guiding plate including a concave curved surface laterally placed under the two vertical side plates, the ball pick-up mechanism further including a fixing shaft laterally extending between the two vertical side plates, a rotating shaft laterally extending between the two vertical side plates, a pair of synchronous belt pulleys provided on each of the fixing shaft and the rotating shaft, each belt pulley being placed inside the two vertical side plates, two synchronous belts each assembled with two of the synchronous belt pulleys on the same side, and laterally placed ball-moving plates evenly distributed on an outer surface of each of the synchronous belts, each of the ball-moving plates having a ball-contacting surface perpendicularly connected to the outer surface of each of the synchronous belts such that the ball-contacting surface travels outside of a closed loop defined by the belts, the ball pick-up mechanism being configured such that the belts and the ball guiding plate are spaced apart a distance greater than a diameter of a tennis ball; and an electric motor coupled to the chassis, the electric motor including an output shaft connected to a wheel shaft of the two driven wheels and also connected to the rotating shaft of the ball pick-up mechanism.

2. The tennis ball pick-up cart of claim 1, further including a rear wheel driving synchronous belt transmission mechanism connecting the electric motor output shaft to the wheel shaft.

3. The tennis ball pick-up cart of claim 1, wherein the chassis includes a power switch, an on-board battery charge socket, a radio signal remote receiver and an electronic speed regulator.

4. The tennis ball pick-up cart of claim 1, further including a pair of curved handle fixing frames fixed to the chassis, the two handle fixing frames being positioned outside the two vertical side plates and outside two sidewalls of the ball collection case, and a laterally extending cart body handle coupled to upper ends of the two handle fixing frames.

5. The tennis ball pick-up cart of claim 4, further including a protective cover, and ends of the protective cover are fixed to the handle fixing frames.

6. The tennis ball pick-up cart of claim 1, wherein the chassis includes a pair of guiding plates positioned at the front end of the chassis, the two guiding plates being placed on opposite sides of the front of the chassis.

7. The tennis ball pick-up cart of claim 1, wherein the ball-contacting surface is planar.

8. The tennis ball pick-up cart of claim 1, wherein the ball-moving plates are cantilever mounted to the belts, each ball-moving plate including an unsupported distal end.

9. A tennis ball pick-up cart, comprising:

a chassis including a pair of driven wheels and a pair of steering wheels;

a ball collection case including an open to coupled to the chassis;

a ball pick-up mechanism including two vertical side plates and a ball guiding plate, the ball guiding plate including a concave curved surface laterally placed under the two vertical side plates, the ball pick-up mechanism further including a fixing shaft laterally extending between the two vertical side plates, a rotating shaft laterally extending between the two vertical side plates, a pair of synchronous belt pulleys provided on each of the fixing shaft and the rotating shaft, each belt pulley being placed inside the two vertical side plates, two synchronous belts each assembled with two of the synchronous belt pulleys on the same side, and laterally placed ball-moving plates evenly distributed on an outer surface of each of the synchronous belts, each of the ball-moving plates having a ball-moving surface perpendicularly connected to the outer surface of each of the synchronous belts;

an electric motor coupled to the chassis, the electric motor including an output shaft connected to a wheel shaft of the two driven wheels and also connected to the rotating shaft of the ball pick-up mechanism;

a rear wheel driving synchronous belt transmission mechanism connecting the electric motor output shaft to the wheel shaft; and a ball-moving plate driving synchronous belt transmission mechanism connecting the electric motor output shaft to the rotating shaft of the ball pick-up mechanism.

10. The tennis ball pick-up cart of claim 9, wherein the ball-moving plate driving synchronous belt transmission mechanism includes an overrunning clutch to move the chassis forward and backward and drive the ball-moving plates in a single direction.

11. A tennis ball pick-up cart, comprising:

a chassis including a pair of driven wheels and a pair of steering wheels;

a ball collection case including an open to coupled to the chassis;

a ball pick-up mechanism including two vertical side plates and a ball guiding plate, the ball guiding plate including a concave curved surface laterally placed under the two vertical side plates, the ball pick-up mechanism further including a fixing shaft laterally extending between the two vertical side plates, a rotating shaft laterally extending between the two vertical side plates, a pair of synchronous belt pulleys provided on each of the fixing shaft and the rotating shaft, each belt pulley being placed inside the two vertical side plates, two synchronous belts each assembled with two of the synchronous belt pulleys on the same side, and laterally placed ball-moving plates evenly distributed on an outer surface of each of the synchronous belts, each of the ball-moving plates having a ball-moving surface perpendicularly connected to the outer surface of each of the synchronous belts;

an electric motor coupled to the chassis, the electric motor including an output shaft connected to a wheel shaft of the two driven wheels and also connected to the rotating shaft of the ball pick-up mechanism, wherein each of the steering wheels is coupled to a steering lever, an upper end of each of the steering levers being connected to a pair of laterally placed steering gear connecting plates, the steering gear connecting plates both being connected to a steering gear, wherein a laterally extending steering gear fixing plate is coupled to the two vertical side plates and the steering gear is fixed on the steering gear fixing plate.

12. A tennis ball pick-up cart, comprising:

a chassis including a pair of driven wheels and a pair of steering wheels;

a ball collection case including an open to coupled to the chassis;

a ball pick-up mechanism including two vertical side plates and a ball guiding plate, the ball guiding plate including a concave curved surface laterally placed under the two vertical side plates, the ball pick-up mechanism further including a fixing shaft laterally extending between the two vertical side plates, a rotating shaft laterally extending between the two vertical side plates, a pair of synchronous belt pulleys provided on each of the fixing shaft and the rotating shaft, each belt pulley being placed inside the two vertical side plates, two synchronous belts each assembled with two of the synchronous belt pulleys on the same side, and laterally placed ball-moving plates evenly distributed on an outer surface of each of the synchronous belts, each of the ball-moving plates having a ball-moving surface perpendicularly connected to the outer surface of each of the synchronous belts;

an electric motor coupled to the chassis, the electric motor including an output shaft connected to a wheel shaft of the two driven wheels and also connected to the rotating shaft of the ball pick-up mechanism; and a pair of brush wheels coupled to the chassis, the two brush wheels being placed on opposite sides at a front end of the chassis, the cart also further including vertically placed brush wheel shafts fixed to the two brush wheels and connected to the rotating shaft via brush wheel transmission belts.

* * * * *